US005255393A

United States Patent [19]

Brady

[11] Patent Number: 5,255,393

[45] Date of Patent: Oct. 26, 1993

[54] FORM FITTING GARMENT

[75] Inventor: Judy A. Brady, Mt. Airy, Md.

[73] Assignee: THGKG Partnership, Silver Spring, Md.

[21] Appl. No.: 732,126

[22] Filed: Jul. 18, 1991

[51] Int. Cl.[5] ..... A41B 11/00

[52] U.S. Cl. ..... 2/409; 450/115; 450/116; 450/117; 450/131; 450/132

[58] Field of Search ..... 2/76, 78 A, 78 R, 78 C, 2/78 D, 79, 218, 217, 221, 223, 237, 240, 409, 110, 109; 450/98, 105, 107, 115, 116, 117, 118, 122, 123, 125, 128, 131, 132, 134; 66/178 A, 178 R

[56] References Cited

U.S. PATENT DOCUMENTS

| | | | |
|---|---|---|---|
| 518,369 | 4/1894 | Leavitt . | |
| 858,107 | 6/1907 | Ruppel . | |
| 1,003,734 | 9/1911 | Goldberg | 2/221 |
| 1,033,066 | 7/1912 | Freedman | 2/221 |
| 1,333,410 | 3/1920 | Graber | 2/221 |
| 1,516,801 | 7/1924 | Weiner et al. . | |
| 1,709,508 | 4/1929 | Weiner et al. . | |
| 1,998,865 | 4/1935 | Fekete . | |
| 2,418,772 | 4/1947 | Jackson | 2/237 |
| 2,687,526 | 8/1954 | Blais . | |
| 2,826,760 | 3/1958 | Rice . | |
| 2,854,006 | 9/1958 | Geimer . | |
| 2,905,947 | 9/1959 | Rosenberg . | |
| 2,955,598 | 10/1960 | Blatt | 450/155 X |
| 3,034,136 | 5/1962 | Halperin . | |
| 3,080,869 | 3/1963 | Alberts | 450/132 X |
| 3,099,014 | 7/1963 | Smith . | |
| 3,362,029 | 1/1968 | Comerma . | |
| 3,512,532 | 5/1970 | Sutter | 450/98 |
| 3,694,816 | 10/1972 | Smith . | |
| 3,815,156 | 6/1974 | Gaither | 2/409 |
| 3,823,419 | 7/1974 | Breitbart . | |
| 3,824,812 | 7/1974 | Matthews et al. . | |
| 3,828,369 | 8/1974 | Swallow . | |
| 3,974,836 | 8/1976 | Carlson | 2/408 X |
| 4,068,321 | 1/1978 | Chayer . | |
| 4,139,913 | 2/1979 | Garin et al. . | |
| 4,156,294 | 5/1979 | Horn | 2/409 X |
| 4,390,999 | 7/1983 | Lawson et al. . | |
| 4,596,055 | 6/1986 | Aach et al. . | |
| 5,038,414 | 8/1991 | Freeman | 2/78 A |
| 5,040,245 | 8/1991 | Staley | 66/178 R X |

FOREIGN PATENT DOCUMENTS

| | | | |
|---|---|---|---|
| 455979 | 10/1936 | United Kingdom | 66/178 |
| 481411 | 3/1938 | United Kingdom | 2/221 |
| 810855 | 3/1959 | United Kingdom | 2/221 |

*Primary Examiner*—Clifford D. Crowder
*Assistant Examiner*—Jeanette E. Chapman
*Attorney, Agent, or Firm*—Larson and Taylor

[57] ABSTRACT

A form fitting garment is provided which accommodates a large abdomen of a user. The garment is maintained in form fitting contact with the abdomen and a remainder of the user covered thereby by being formed generally of a first stretchable material. The garment includes a waistband which is expandable and which is also adjustable in size and a front panel which is connected to a front portion of the waistband and which extends downwardly therefrom to cover the abdomen of the user. This front panel is made of an extra stretchable material which is more stretchable than the first stretchable material, and optionally is supportive. The garment can also include an extra stretchable and supportive back panel which is connected to a back portion of the waistband and which extends downwardly therefrom to cover the buttocks of the user. A crotch is connected between the front panel and the back to cover the crotch of the user, and the crotch is either extra stretchable or supportive. Respective left and right sides panels, which are extra stretchable and optionally supportive, are optionally connected between respective left and right portions of the front panel and the back. Preferably, the front panel, crotch panel, and side panels are made of a breathable material.

20 Claims, 2 Drawing Sheets

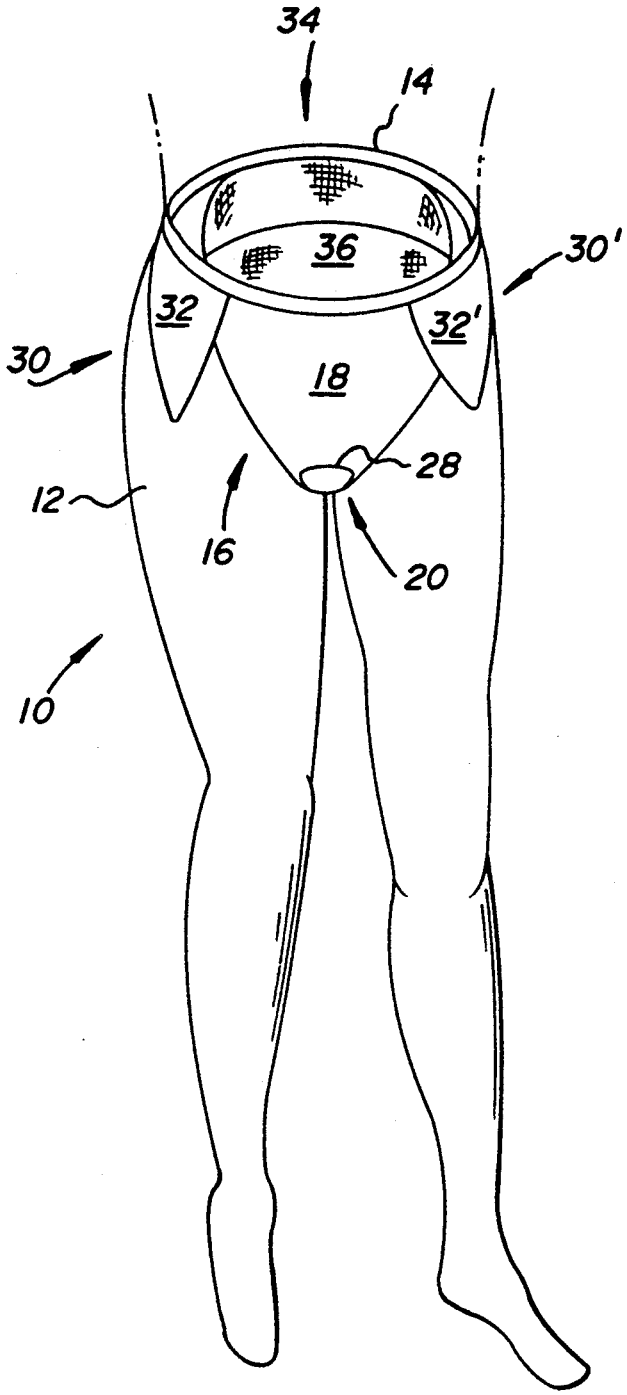
Fig. 1
Fig. 3
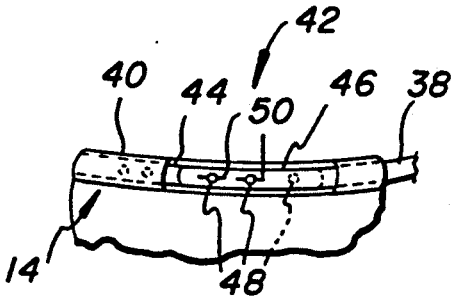
Fig. 4
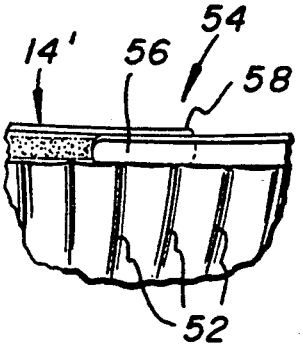
Fig. 2
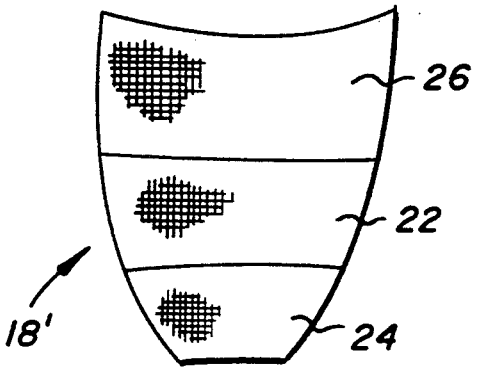

FORM FITTING GARMENT

FIELD OF THE INVENTION

The present invention relates generally to a form fitting garment, and more particularly to a form fitting garment which is designed to be comfortably and adjustably worn by pregnant women or non-pregnant women with large abdomens.

BACKGROUND OF THE INVENTION

Garments which are designed to be worn by pregnant women and which accommodate abdominal growth, or which are worn by obese persons and accommodate associated large abdomens, have been disclosed in the prior art. Following is a brief description of some of these prior garments as well as other specialized garments of interest.

In U.S. Pat. No. 3,824,812 (Matthews et al.), a panty garment is disclosed in which more courses are provided at the front and rear of the panty than the number of courses at the side or lateral portions. With this construction, the bottoms of the lateral portions rise above the crotch thereof when worn.

In U.S. Pat. No. 2,905,947 (Rosenberg), a maternity panty is disclosed in which a front panel is provided with a very substantial degree of uniform elasticity in the vertical direction. Both the front and rear panels also have some normal horizontal elasticity. This panty is designed for expansion in the vertical direction over the abdomen.

In U.S. Pat. No. 2,854,006 (Geimer), a maternity garment is provided with a shirred front panel capable of expanding vertically and horizontally without exerting appreciable pressure. Associated with this front panel is a separate sling member of elastic material which extends across the lower margin of the front panel to provide additional uplift control of this lower margin. The elastic sling member is attached at its ends to the waist band. With this construction, a substantial and strong support is afforded around the lower contour of the abdomen.

In U.S. Pat. No. 4,390,999 (Lawson et al.), a panty hose with body bulge control is disclosed. In one embodiment, an intermediate compressive force of a body bulge controlling portion is provided between the highly compressive waistband and the upper portion of a sheer panty portion. The intermediate compressive force of the body bulge controlling portion provides a gradually varying or stepped amount of compressive force over a substantial area of the body to reduce and minimize the visible bulge line normally present adjacent the juncture of the portions of a panty hose having relatively great and relatively small amounts of compressive force.

In U.S. Pat. No. 2,687,526 (Blais), a maternity undergarment is disclosed having the upper anterior portion open and only a short front panel is provided above a crotch section. An elastic linear member extends across the back, over the hips, and downwardly laterally of the abdomen where it is secured to the upper anterior portion and serves as a hose supporter.

In U.S. Pat. No. 3,034,136 (Halperin), a garment is disclosed which is designed to accommodate abdominal size changes. The garment includes a waistband which is elastic except adjacent a front panel thereof where a hem and a drawstring are provided. The front panel is also generally stretchable.

In U.S. Pat. No. 4,139,913 (Garin et al.), an extensible maternity slacks is disclosed. The extension is provided by having a front flap adapted to be joined to the edge of a rear flap by a button-hole co-operating with a plurality of buttons.

In U.S. Pat. No. 3,694,816 (Smith), a maternity panty hose garment is disclosed which includes U-shaped elastic gusset panels provided on each side to provide substantial expansion and support in the panty area without unduly constricting the abdomen of the wearer as it increases in size during pregnancy.

While various garments are disclosed in the prior art, none of these garment adequately allow for the adjustment and comfort of pregnant or obese women.

SUMMARY OF THE INVENTION

In accordance with the present invention, a form fitting garment is provided which accommodates a large abdomen of a user. The garment is maintained in form fitting contact with the abdomen and a remainder of the user covered thereby by being formed generally of a first stretchable material. The garment includes a waistband which is expandable and which may also be adjustable in size and a front panel which covers the abdomen of the user. This front panel is made of an extra stretchable material which is more stretchable than the first stretchable material. The garment also includes a back which covers the buttocks of the user. A crotch area extending between the front panel and the back covers the crotch of the user, and respective left and right sides are connected between respective left and right portions of the front panel and the back.

It is also a feature of the present invention that the front panel may be additionally variably supportive from a maximum support adjacent the bottom thereof, preferably at the crotch panel to a substantially reduced support adjacent the top thereof, preferably the waistband. Conveniently, in a preferred form, the front panel includes a middle portion which is supportive, a lower portion which is more supportive than the middle portion, and an upper portion which is less supportive than the middle portion.

It is a further feature of the invention that the crotch may include a crotch panel which is made of an extra stretchable material which is more stretchable than the first stretchable material. Alternatively, the crotch may include a supportive crotch panel.

Still another feature of the present invention is that each side may include a side panel which is made of an extra stretchable material which is also more stretchable than the first stretchable material. Advantageously, each side panel is also variably supportive from a maximum support adjacent a lowermost portion to a substantially reduced support adjacent the top thereof, preferably at waistband. Conveniently, this is accomplished by providing each side panel with a middle portion which is supportive, a lower portion which is more supportive than the middle portion, and an upper portion which is less supportive than the middle portion.

Another feature of the present invention is that the back may include a back panel which is made of an extra stretchable material which is more stretchable than the first stretchable material and which is variably supportive from a maximum support adjacent the bottom thereof, preferably at the crotch panel and to a reduced support adjacent the top thereof, preferably at the waistband. Conveniently, the back panel may include a middle portion which is supportive, a lower portion which is more supportive than the middle portion, and an upper portion which is less supportive than the middle portion.

Still another feature of the invention is the use of an adjustable waistband. In one preferred embodiment where the side is simply made of the first stretchable material, the waistband includes an encircling member and a means for removably attaching an end of the encircling member to a remaining portion of the encircling member at different locations such that the circumference of the encircling member is easily adjustable. In another of the preferred embodiments, the waistband includes a portion adjacent each side panel and an adjustment means for adjusting the length of the portion whereby an associated side panel is gatherable.

In a preferred embodiment, the front panel, the back panel, the crotch panel and the side panels may be made of a breathable material.

In one embodiment, the form fitting garment further includes legs connected to the front panel, the crotch, the sides, and the back to form a pantyhose.

In other embodiments, the features of the present invention may be employed in various types of garments. These may include drawers, tights, full body garments and leotards. There are several types of leotards on which the present invention may be employed, such as a lower body leotard, a full body leotard which extends from the crotch up to cover the full upper body of the user, or leggings, which extend from the waist down to a lower end which may be at the user's knee, calf or ankle or may cover the entire foot.

Thus, it is an object of the present invention to provide a new and improved form fitting garment for pregnant or non-pregnant obese women.

Other objects and advantages of the present invention will become apparent from the detailed description to follow.

BRIEF DESCRIPTION OF THE DRAWINGS

FIG. 1 is a schematic perspective view of a form fitting garment of the present invention having a variety of the various possible features.

FIG. 2 is an elevational view of a front panel having portions with variable support.

FIG. 3 is an elevational view of a portion of a first embodiment of a waistband.

FIG. 4 is an elevational view of a portion of a second embodiment of a waistband.

DETAILED DESCRIPTION OF THE PREFERRED EMBODIMENTS

Figure 5:
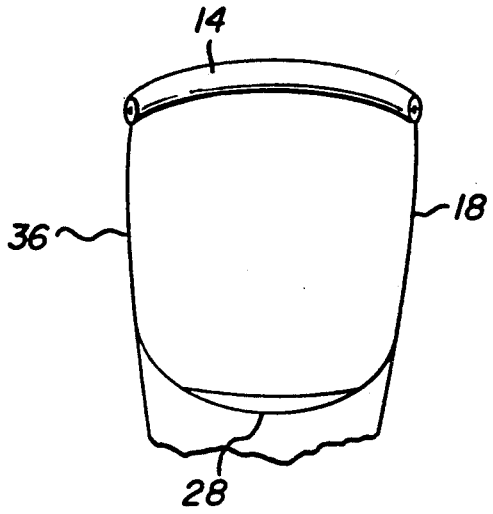
FIG. 5 is a cross-sectional right side view of the form fitting garment depicted in FIG. 1.
Figure 6A:
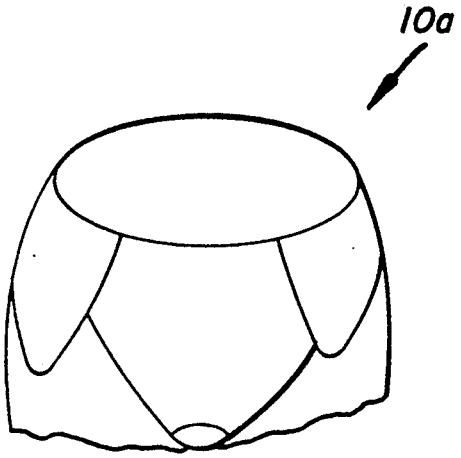
FIGS. 6*a* and 6*b* show different embodiments of garments using the features of the present invention.
Figure 6B:
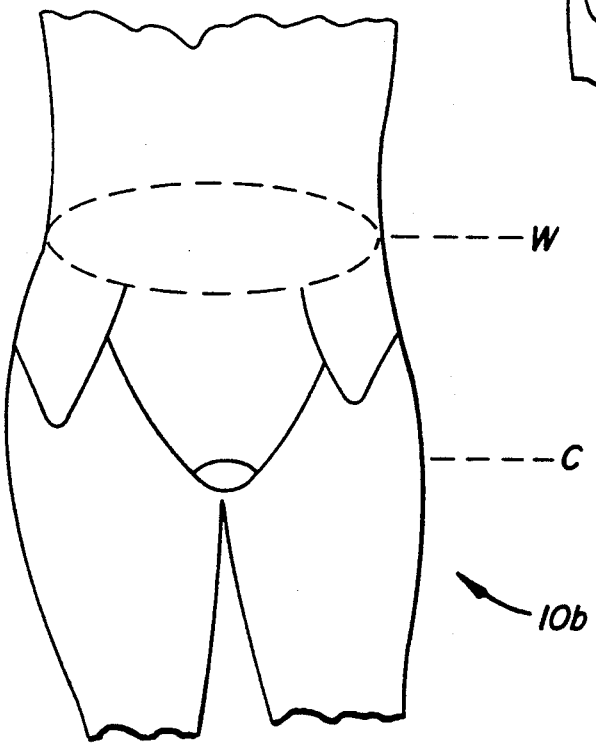

With reference now to the drawings where like numerals represent like elements throughout the views, a form fitting exemplary garment 10 is shown in FIG. 1. Garment 10 is particularly designed for use by pregnant or obese women. For a pregnant women, it is usable throughout the pregnancy because garment 10 is adjustable in a number of ways. Obviously, garment 10 is also usable by anyone with a large abdomen where comfort and/or adjustability is a factor. The embodiment of garment 10 shown in FIG. 1 is a pantyhose. However, as shown schematically in FIGS. 6*a* and 6*b*, the garment can take many different forms. FIG. 6*a* shows a waist to crotch garment 10*a* which represents drawers or lower body leotards. FIG. 6*b* shows a garment 10*b* extending above the waist which represents (a) a full body suit, (b) a full body leotard, which covers the upper body and extends down to line C at the level of the crotch or (c) legging leotards which would extend from the waist level W downwardly to a lower end located at the knee, calf or ankle or to the toe, covering the entire foot. Any full body garment may include an expandable and/or adjustable waistband.

Referring to FIG. 1, garment 10 has a waistband 14, a front 16, a crotch 20, sides 30 and 30', and a back 34, and is typically formed of a stretchable material 12 such as nylon so that garment 10 is form fitting. However, it will be appreciated that stretchable material 12 is typically too binding and/or uncomfortable for those with an enlarged abdomen, and this becomes increasingly so for pregnant women as pregnancy progresses. Thus, garment 10 includes waistband 14 which is both expandable and adjustable. As discussed subsequently with respect to FIG. 3 which shows waistband 14 in greater detail or FIG. 4 which shows an alternative waistband 14', the waistband is adjustable in different ways, wherein the selection of a given waistband depends on the particular configuration of garment 10.

As shown in FIG. 1, front 16 of garment 10 includes a support portion which, in FIG. 1, takes the form of a front panel 18. Front panel 18 may, at its upper end be connected to a front portion of waistband 14. It extends downwardly to cover the abdomen of the user. Front panel 18 is made of an extra stretchable material, i.e., a material which is more stretchable than stretchable material 12.

As shown in FIG. 1, the first panel is connected to the remainder of the garment 10 on both sides thereof. In addition, if desired, front panel 18 can also be variably supportive. Such variable support is from a maximum support adjacent the bottom thereof, preferably at crotch 20 to a substantially reduced support at the top thereof, preferably adjacent waistband 14. The support is provided at least side to side and preferably in all directions of the plane of the material.

In one preferred embodiment, the variable support is accomplished by use of a front panel 18' as shown in FIG. 2 in place of front panel 18. Front panel 18' has a plurality of sections, in this case three sections, with different levels of reinforcing or different meshes. Thus, front panel 18' includes a middle portion 22 which is supportive (medium elasticity, side to side at least), a lower portion 24 which is more supportive (less elastic, side to side at least) than middle portion 22, and an upper portion 26 which is less supportive (easily stretches) than middle portion 22.

Crotch 20 of garment 10 includes a crotch panel 28. Crotch panel 28 is preferably also made of an extra stretchable material, such as the same material used for front panel 18. Alternatively, crotch panel 28 can be made of a supportive material which provides support equal to or even greater than stretchable material 12.

Garment 10 also includes sides 30 and 30'. Sides 30 and 30' are mirror reflections of one another, so that only side 30 is discussed in detail and the similar elements of side 30' are identified with the same numerals with a prime (') added. Side 30 includes a generally "V" shaped side panel 32. Side panel 32 is also made of an extra stretchable material, i.e., a material which is more stretchable than stretchable material 12. In addition, if desired, side panel 32 is also variably supportive from a maximum support at a lowermost point to a substantially reduced support, preferably adjacent waistband 14. This variable support is accomplished by forming side panel 32 in the same manner as front panel 18' discussed above, i.e., in a plurality of sections having different levels of reinforcing or different meshes.

Back 34 of garment 10 includes a back panel 36. Back panel 36 is connected to a back portion of waistband 14 and extends downwardly therefrom to cover the buttocks of the user. Back panel 36 is made of an extra stretchable material, i.e., a material which is more stretchable than stretchable material 12. In addition, back panel 36 may also be variably supportive from a maximum support at the bottom thereof, preferably adjacent crotch panel 28 to a substantially reduced support at the top thereof, preferably adjacent waistband 14. This variable support is preferably accomplished by forming back panel 36 in the same manner as front panel 18' discussed above, that is in a plurality of sections having different levels of reinforcing or different meshes as shown in FIG. 2.

As discussed above, garment 10 includes an expandable and adjustable waistband 14. In one embodiment, as shown in FIG. 3, waistband 14 includes an adjustable and expandable belt 38 which is received in an extra expandable soft sleeve member 40 provided with an opening 42. At opening 42, ends 44 and 46 of belt 38 overlap and form an adjustment means for belt 38. As shown, end 44 of belt 38 is provided with a plurality of spaced buttons 48 or the like while end 46 of belt 38 is provided with two buttonholes 50. Thus, it will be appreciated that waistband 14 is adjustable by changing which buttons 48 of end 44 are received in the two buttonholes 50 of end 46. In addition, as belt 38 and sleeve member 40 are also expandable at any given adjustment, waistband 14 remains comfortable and not rigid at any given adjustment. The location of opening 42 may be at a convenient place for adjustment, such as above front panel 18.

FIG. 4 shows an alternative embodiment of a waistband 14'. Waistband 14' is specifically designed for use where garment 10 includes side panels 32 and 32' which are gatherable as shown by gathers 52. In such embodiments of garment 10, waistband 14' is generally soft and expandable so as to be comfortable to the user. In addition, waistband 14' includes an adjustment means 54 formed at that portion of waistband 14' adjacent side panels 32 and 32'. As shown in FIG. 4, adjustment means 54 includes separate tabs 56 and 58 which are provided on overlapping sides thereof with complimentary Velcro fastening surfaces or the like. Thus, the lateral size of side panels 32 and 32' and the extent of gathers 52 are adjustable by the relative positions of respective tabs 56 and 58.

In the preferred embodiment of garment 10, wherein the stretchable material is typically nylon, it is preferred to make front panel 18, crotch panel 28, side panels 32 and 32', and back panel 36 all from a breathable as well as stretchable material. For this purpose, it is believed that some type of cotton material or the like would be used, with suitable reinforcements (such as a mesh of the stretchable material, particularly where the stretchable material is nylon) as necessary for the particular application. The use of such a breathable material helps to reduce perspiration thereunder and the associated itching and skin irritation.

Garment 10 as shown in FIG. 1 illustrates various features which can be incorporated in a garment according to the present invention. It will be appreciated by the following exemplary embodiments or examples of the present invention that these features may be combined in various ways to provide a garment which is particularly designed to be worn either by pregnant women to accommodate expanding abdomens which is adjustable and comfortable or by non-pregnant women having large abdomens.

EXAMPLE 1

The garment according to this example is generally made of stretchable material 12, but includes expandable and adjustable waistband 14, stretchable front panel 18, and stretchable crotch panel 28. With this embodiment, front panel 18 is capable of expanding comfortably as the abdomen of the user enlarges during pregnancy. In addition, by having adjustable waistband 14, personal sizing of the waistband for maximum comfort is also possible. It should also be appreciated that the noted panels are made of a breathable material as discussed above. Thus, the skin is allowed to breathe in these areas and this reduces the tendency to perspire which occurs with the usual stretchable material 12 of the garment. The use of the breathable material in this manner helps to reduce perspiration in these areas, which perspiration could otherwise lead to skin irritation and itching, and particularly to yeast infections which are particularly a problem during pregnancy.

EXAMPLE 2

The garment according to this example is generally similar to that of Example 1 (expandable and adjustable waistband 14, stretchable front panel 18, and stretchable crotch panel 28) with the additional features of side panels 32 and 32' and thus associated waistband 14' (instead of waistband 14) with adjustment means 54 which are used with side panels 32 and 32' as mentioned above. Side panels 32 and 32' are also preferably made of a breathable material to help reduce perspiration. It will be appreciated that this garment has the same advantages as that of Example 1. In addition, the presence of side panels 32 and 32' together with waistband 14' provide an added way to adjust the garment depending on how the baby is being carried. For example, some women find that they need additional room on the sides instead of the front during pregnancy and this can be accomplished by adjusting means 54 of waistband 14' to increase or reduce gathers 52 in side panels 32 and 32'.

EXAMPLE 3

The garment according to this example is generally similar to that of Example 1 (expandable and adjustable waistband 14, stretchable front panel 18, and stretchable crotch panel 28) with the additional feature that front panel 18' is used instead of front panel 18. It will be appreciated that this garment has the same advantages as that of Example 1. In addition, by allowing different areas of support on front panel 18', front panel 18' provides uplift and support for the abdomen. This helps to maintain muscle tone of the expanding abdomen, which in turn helps to reduce abdominal pressure as well as upper leg and groin discomfort. It should also be appreciated that the supportive feature of front panel 18' is used in conjunction with adjustable waistband 14. Therefore, the supportive force of front panel 18' is adjustable by the adjustment of waistband 14, according to the comfort level desired by the user.

EXAMPLE 4

The garment according to this example is generally similar to that of Example 3 (expandable and adjustable waistband 14, variably supportive front panel 18', and stretchable crotch panel 28) with the additional feature that crotch panel 28 is not stretchable but instead is formed of a supportive material. It will be appreciated that this garment has the same advantages as that of Example 3. In addition, by providing crotch panel 28 with a moderate support, crotch panel 28 helps to reduce vulvar varicoses and to relieve pelvic congestion. It should further be appreciated that the supportive crotch panel 28 together with supportive front panel 18' provide uplift and support from the crotch to the abdomen which further aids in relieving pelvic congestion.

EXAMPLE 5

The garment according to this example is generally similar to that of Example 3 (expandable and adjustable waistband 14, variably supportive front panel 18', and stretchable crotch panel 28) with the additional feature that side panels 32 and 32' are provided together with associated waistband 14' having adjustment means 54 (instead of waistband 14). It will be appreciated that this garment has the same advantages as that of Example 3. In addition, and as noted above with reference to Example 2, by providing side panels 32 and 32' with associated adjustment means 54, there is provided an added way to adjust the garment (depending on how the baby is being carried) so that additional room on the sides instead of the front can be provided.

EXAMPLE 6

The garment according to this example is generally similar to that of Example 5 (expandable and adjustable waistband 14', variably supportive front panel 18', crotch panel 28, and side panels 32 and 32') with the additional feature that side panels 32 and 32' are variably supportive in the same manner as front panel 18'. It will be appreciated that this garment has the same advantages as that of Example 5. In addition, side panels 32 and 32' supply a similar variable uplift and support together with variably supportive front panel 18' to further help increase muscle support and tone and to relieve pelvic congestion and pressure.

EXAMPLE 7

The garment according to this example is generally similar to that of Example 4 (expandable and adjustable waistband 14, variably supportive front panel 18', and supportive crotch panel 28) with the additional feature that side panels 32 and 32' are provided together with waistband 14' having adjustment means 54 (instead of waistband 14). It will be appreciated that this garment has the same advantages as that of Example 4 as well as the advantages associated with the use of side panels 32 and 32' discussed in Example 2.

EXAMPLE 8

The garment according to this example is generally similar to that of Example 7 (expandable and adjustable waistband 14', variably supportive front panel 18', supportive crotch panel 28, and side panels 32 and 32') with the additional feature that side panels 32 and 32' are variably supportive in the same manner as front panel 18'. It will be appreciated that this garment has the same advantages as that of Example 7. In addition, by providing support from all of the areas of crotch panel 28, front panel 18', and side panels 32 and 32', all of these elements are working together for total support and the benefits mentioned in the noted examples.

EXAMPLE 9

The garment according to this example is generally similar to that of Example 3 (expandable and adjustable waistband 14, variably supportive front panel 18', and stretchable crotch panel 28) with the additional feature that variably supportive back panel 36 is provided. It will be appreciated that this garment has the same advantages as that of Example 3. In addition, by providing a mirror image of the variable support in front panel 18' with back panel 36, the variable support from both panels 18' and 36 help to lower back discomfort by making up for the lack of support in these areas as the abdomen expands during pregnancy. It should also be appreciated that where this garment is a maternity pantyhose, such a maternity pantyhose is typically worn with a dress and shoes with a heel of some sort. This causes additional stress to the back, which will be compensated for with the use of the variably supportive back panel 36.

EXAMPLE 10

The garment according to this example is generally similar to that of Example 4 (expandable and adjustable waistband 14, variably supportive front panel 18', and supportive crotch panel 28) with the additional feature that variably supportive back panel 36 is provided. It will be appreciated that this garment has the same advantages as that of Example 4 as well as the advantages associated with the use of variably supportive back panel 36 discussed in Example 9.

EXAMPLE 11

The garment according to this example is generally similar to that of Example 5 (expandable and adjustable waistband 14', variably supportive front panel 18', stretchable crotch panel 28, and stretchable side panels 32 and 32') with the additional feature that variably supportive back panel 36 is provided. It will be appreciated that this garment has the same advantages as that of Example 5 as well as the advantages associated with the use of variably supportive back panel 36 discussed in Example 9.

EXAMPLE 12

The garment according to this example is generally similar to that of Example 8 (expandable and adjustable waistband 14', variably supportive front panel 18', supportive crotch panel 28, and variably supportive side panels 32 and 32') with the additional feature that variably supportive back panel 36 is provided. It will be appreciated that this garment has the same advantages as that of Example 8 as well as the advantages associated with the use of variably supportive back panel 36 discussed in Example 9.

The above examples have been used to describe various preferred embodiments of the present invention, with that of Example 11 being the one most preferred. However, it will be appreciated that other variations and modifications are possible using the unique features of the present invention. Thus, while the present invention has been described with respect to exemplary embodiments thereof, it will be understood by those of ordinary skill in the art that variations and modifications can be effected within the scope and spirit of the invention.

I claim:

1. A form fitting garment which accommodates a large abdomen of a user and which is maintained in form fitting contact with the abdomen and other portions of the user covered thereby by being formed generally of a first stretchable material, said garment comprising:

a waistband which is expandable and which is also adjustable in size.

a front panel which covers the abdomen of the user, said front panel being made of an extra stretchable material which is more stretchable than the first stretchable material;

a back which covers the buttocks of the user;

a crotch area covering the crotch of the user; and respective left and right sides covering respective left and right sides of the user, wherein said front panel is variable supportive from a maximum support adjacent a bottom thereof to a substantially reduced support adjacent a top thereof.

2. A form fitting garment as claimed in claim 1 wherein said front panel includes a middle portion which is supportive, a lower portion which is more supportive than said middle portion, and an upper portion which is less supportive than said middle portion.

3. A form fitting garment as claimed in claim 1 wherein said waistband includes an encircling member and a means for removably attaching an end of said encircling member to a remaining portion of said encircling member at different locations such that the circumference of said encircling member is easily adjustable.

4. A form fitting garment as claimed in claim 1 wherein each said side includes a side panel which is made of an extra stretchable material which is more stretchable than the first stretchable material.

5. A form fitting garment as claimed in claim 4 wherein said bank includes a back panel having a top and a bottom and which is made of an extra stretchable material which is more stretchable than the first stretchable material and which is variably supportive from a maximum support near the bottom thereof to a substantially reduced support near the top thereof.

6. A form fitting garment as claimed in claim 5 wherein said front panel, said back panel and said side panels are made of a breathable material.

7. A form fitting garment as claimed in claim 5 wherein said waistband includes a portion adjacent each said side panel and an adjustment means for adjusting the length of said portion whereby an associated said side panel is gatherable.

8. A form fitting garment as claimed in claim 4 wherein each said side panel has a top and a bottom and is variably supportive from a maximum support adjacent the bottom thereof to a substantially reduced support adjacent the top thereof.

9. A form fitting garment as claimed in claim 4 wherein said waistband includes a portion adjacent each said side panel and an adjustment means for adjusting the length of said portion whereby an associated said side panel is gatherable.

10. A form fitting garment as claimed in claim 1 wherein said back includes a back panel having a top and a bottom and which is made of an extra stretchable material which is more stretchable than the first stretchable material which is variably supportive from a maximum support near the bottom thereof to a substantially reduced support near the top thereof.

11. A form fitting garment which accommodates a large abdomen of a user and which is maintained in form fitting contact with the abdomen and other portions of the user covered thereby by being formed generally of a first stretchable material, said garment comprising:

a waistband which is expandable and which is also adjustable in size;

a front panel which covers the abdomen of the user, said front panel being made of an extra stretchable material which is more stretchable than the first stretchable material;

a back which covers the buttocks of the user;

a waistband which is expandable and which is also adjustable in size;

a crotch area covering the crotch of the user; and separate left and right sides covering respective left and right sides of the user;

wherein said front panel is variably supportive from a maximum support adjacent the bottom thereof to a substantially reduced support adjacent the top thereof, said crotch area including a supportive crotch panel.

12. A form fitting garment as claimed in claim 11 wherein each said side includes a side panel which is made of an extra stretchable material which is more stretchable than the first stretchable material.

13. A form fitting garment as claimed in claim 12 wherein each said side panel has a top and a bottom and is variably supportive from a maximum support adjacent the bottom thereof to a substantially reduced support near the top thereof.

14. A form fitting garment as claimed in claim 13 wherein each said side panel includes a middle portion which is supportive, a lower portion which is more supportive than said middle portion, and an upper portion which is less supportive than said middle portion.

15. A form fitting garment as claimed in claim 11 wherein said back includes a back panel having a top and a bottom and which is made of an extra stretchable material which is more stretchable than the first stretchable material and which is variably supportive from a maximum support adjacent the bottom thereof to a substantially reduced support near the top thereof.

16. A form fitting garment as claimed in claim 15 wherein each said side panel has a top and a bottom and is variably supportive from a maximum support adjacent the bottom thereof to a substantially reduced support adjacent the top thereof.

17. A form fitting garment which accommodates a large abdomen of a user and which is maintained in form fitting contact with the abdomen and other portions of the user covered thereby by being formed generally of a first stretchable material, said garment comprising:

an expandable waistband;

a front panel which covers the abdomen of the user, said front panel having a top and a bottom and being made of an extra stretchable material which is more stretchable than the first stretchable material, the material of the front panel being variably supportive from a maximum support near the bottom thereof to a substantially reduced support near the top thereof;

a back which covers the buttocks of the user;

a crotch area covering the crotch of the user; and left and right sides covering, respectively, left and right sides of the user.

18. A form fitting garment as claimed in claim 17 wherein the waistband is adjustable.

19. A form fitting garment as claimed in claim 18 wherein the variably supportive front panel extends up to the waistband.

20. A form fitting garment as claimed in claim 19 including a back panel having a top and a bottom and which is variably supportive from a maximum support at the bottom thereof to a substantially reduced support at the top thereof.

* * * * *

UNITED STATES PATENT AND TRADEMARK OFFICE

CERTIFICATE OF CORRECTION

PATENT NO. : 5,255,393

DATED : October 26, 1993

INVENTOR(S) : Brady, Judy A.

It is certified that error appears in the above-indentified patent and that said Letters Patent is hereby corrected as shown below:

Title page, item [73], Assignee: should read--"THGKG Partnership; a part interest".

Signed and Sealed this

First Day of November, 1994

Bruce Lehman

*Attest:*

BRUCE LEHMAN

*Attesting Officer*

*Commissioner of Patents and Trademarks*